US009336765B2

(12) United States Patent
Ishii

(10) Patent No.: US 9,336,765 B2
(45) Date of Patent: May 10, 2016

(54) PICKUP DEVICE

(71) Applicant: YAMAHA CORPORATION, Hamamatsu-shi, Shizuoka (JP)

(72) Inventor: Jun Ishii, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/334,818

(22) Filed: Jul. 18, 2014

(65) Prior Publication Data

US 2015/0020676 A1 Jan. 22, 2015

(30) Foreign Application Priority Data

Jul. 19, 2013 (JP) ..... 2013-151074

(51) Int. Cl.
*G10H 3/00* (2006.01)
*G10H 3/18* (2006.01)

(52) U.S. Cl.
CPC ..... *G10H 3/18* (2013.01); *G10H 3/185* (2013.01); *G10H 3/186* (2013.01); *G10H 2220/395* (2013.01)

(58) Field of Classification Search
CPC ..... G10H 3/18; G10H 3/185; G10H 3/186; G10H 2220/395
USPC ..... 84/723
See application file for complete search history.

(56) References Cited

U.S. PATENT DOCUMENTS

| | | | | |
|---|---|---|---|---|
| 2,001,723 | A | 5/1935 | Hammond, Jr. | |
| 3,624,264 | A | 11/1971 | Lazarus | |
| 5,581,484 | A * | 12/1996 | Prince | 702/150 |
| 6,605,771 | B1 * | 8/2003 | Baggs | 84/731 |
| 7,636,447 | B2 * | 12/2009 | Saint-Vincent et al. | 381/152 |
| 2009/0114080 | A1 * | 5/2009 | Uehara | 84/600 |
| 2013/0061733 | A1 | 3/2013 | Ohnishi et al. | |
| 2014/0260906 | A1 * | 9/2014 | Welch | 84/603 |

FOREIGN PATENT DOCUMENTS

| | | | |
|---|---|---|---|
| EP | 2058798 | A2 | 5/2009 |
| EP | 2571016 | A2 | 3/2013 |
| JP | 61-34558 | Y2 | 12/1980 |
| JP | 07-248760 | A | 9/1995 |
| JP | 2003-186476 | A | 7/2003 |
| JP | 2007-049578 | A | 2/2007 |
| JP | 2012150235 | A | 8/2012 |

OTHER PUBLICATIONS

European Search Report issued in European counterpart application No. EP14177618.7, dated Dec. 1, 2014.

* cited by examiner

*Primary Examiner* — Jeffrey Donels
(74) *Attorney, Agent, or Firm* — Rossi, Kimms & McDowell LLP

(57) ABSTRACT

A pickup device includes: a speed detector which is configured to detect speed of vibration of a soundboard of an acoustic musical instrument; and a signal generator which is configured to generate an audio signal from the speed detected by the speed detector and to output the audio signal.

12 Claims, 5 Drawing Sheets

PICKUP DEVICE

BACKGROUND

The present invention relates to a pickup device, and more particularly, to a technique for converting the sound of an acoustic musical instrument, such as a piano, into an electrical signal.

There is a pickup device for converting the sound of a piano into an electrical signal. For example, a technique in which the vibration of a string of a piano is detected using a piezoelectric element provided on a bridge has been disclosed in JP-UM-Y-61-034558. In addition, a technique in which a microphone is provided in the vicinity of the soundboard of a piano and the sound emitted from the soundboard is picked up using the microphone has been disclosed in JP-A-7-248760 and JP-A-2007-049578. Furthermore, a technique in which the displacement (twice integration of acceleration) of the soundboard of a piano is detected using a vibration sensor, such as an acceleration sensor mounted on the back surface of the soundboard of the piano, and sound sampling is performed has been disclosed in JP-A-2003-186476.

According to the above-mentioned related-art technique in which the vibration of a string of a piano is detected using a piezoelectric element, only the vibration of the string can be detected and the vibration information of the soundboard is not considered, whereby sound information is insufficient and it is difficult to reproduce the sound of the piano. Besides, the piezoelectric element is required to be mounted on the bridge corresponding to each string, whereby there is a problem that the wiring work and the manufacturing process for the piano become complicated.

According to the above-mentioned related-art technique in which the sound emitted from the soundboard of a piano is picked up using a microphone, part of the sound output from a speaker is fed back to the microphone, whereby there is a fear that howling occurs. In addition, there is a problem of picking up unwanted ambient sound. Furthermore, know-how is required for the setting of the microphone, whereby it is not easy to pick up high quality sound.

According to the above-mentioned related-art technique in which the displacement of the soundboard of a piano is detected using an acceleration sensor, only the displacement in the amplitude direction of the soundboard can be detected. Since the displacement does not directly affect sound pressure (sound pressure is not proportional to the displacement), the obtained sound lacks a sense of reality, and it is difficult to completely reproduce the sound of the piano.

SUMMARY

The present invention may provide a pickup device capable of suppressing the occurrence of howling and reproducing the natural sound of an acoustic musical instrument, such as a piano.

The pickup device may comprise: a speed detector configured to detect speed of vibration of a soundboard of an acoustic musical instrument; and a signal generator configured to generate an audio signal from the speed detected by the speed detector and to output the audio signal.

The speed detector may comprise at least: an acceleration sensor configured to detect acceleration of the vibration of the soundboard of the acoustic musical instrument; and an integrator configured to integrate an output signal of the acceleration sensor.

The acceleration sensor may be provided on the soundboard.

The acceleration sensor may be a multidimensional acceleration sensor.

The multidimensional acceleration sensor may be provided so that one direction in which the multidimensional sensor detects the acceleration is parallel with a direction of a grain from which the soundboard is formed.

The acoustic musical instrument may be a piano, and the speed detector may be provided at a position opposed to a bridge or a sound rib with the soundboard held therebetween or provided in the vicinity of the sound rib.

DETAILED DESCRIPTION OF EXEMPLARY EMBODIMENTS

Figure 1:
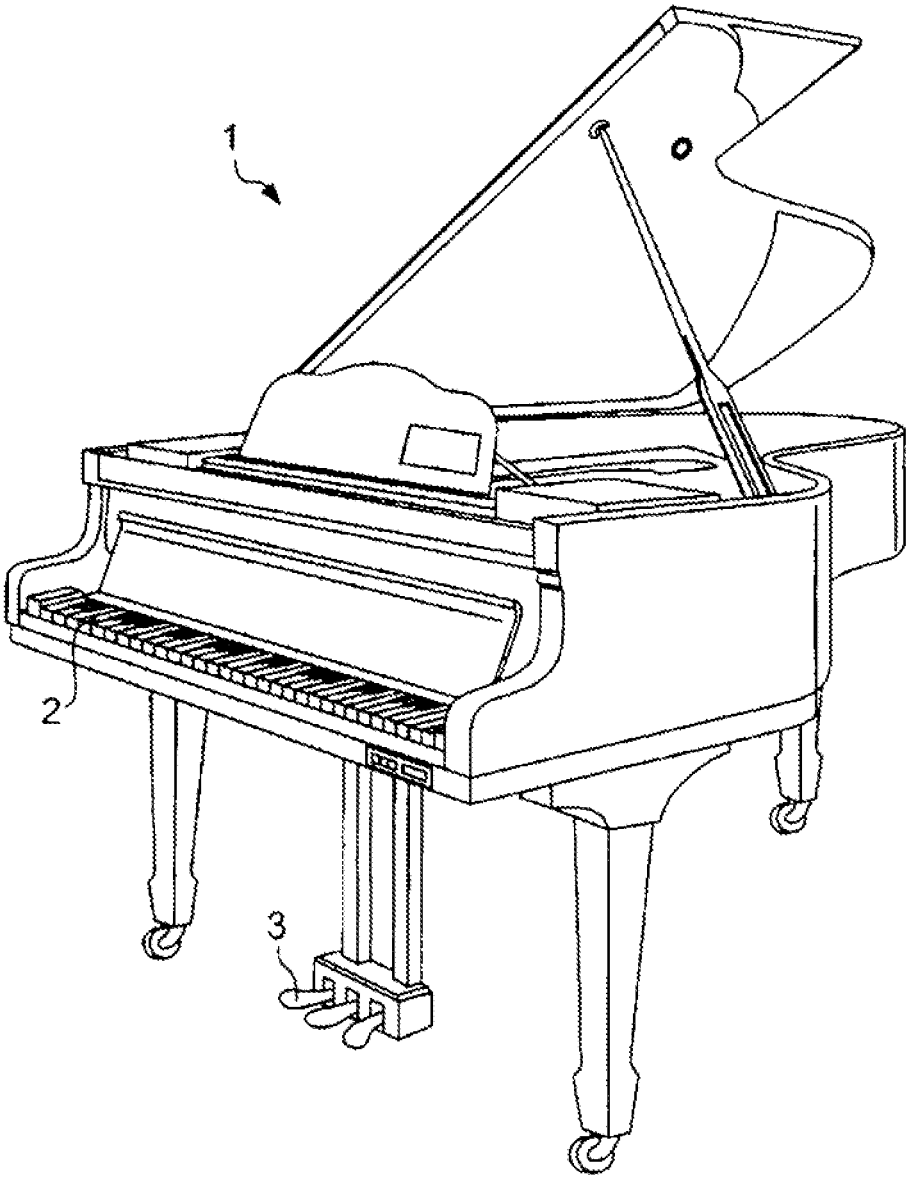
FIG. 1 is a perspective view showing the outside appearance of a grand piano according to a first embodiment.

Embodiments according to the present invention will be described below referring to the drawings.

In the embodiments described below, a case in which a pickup device according to the present invention is applied to a grand piano is taken as an example and described. However, the pickup device according to the present invention is applicable to any acoustic musical instruments equipped with a soundboard, such as a violin and a guitar.

<First Embodiment>

FIG. 1 is a perspective view showing the outside appearance of a grand piano 1 according to a first embodiment.

Like a related-art grand piano, this grand piano 1 has, on its front side, a keyboard in which a plurality of keys 2 to be played by the hands of a player are arranged, and also has pedals 3 for performance control.

(Configuration of the Grand Piano 1)

Figure 2:
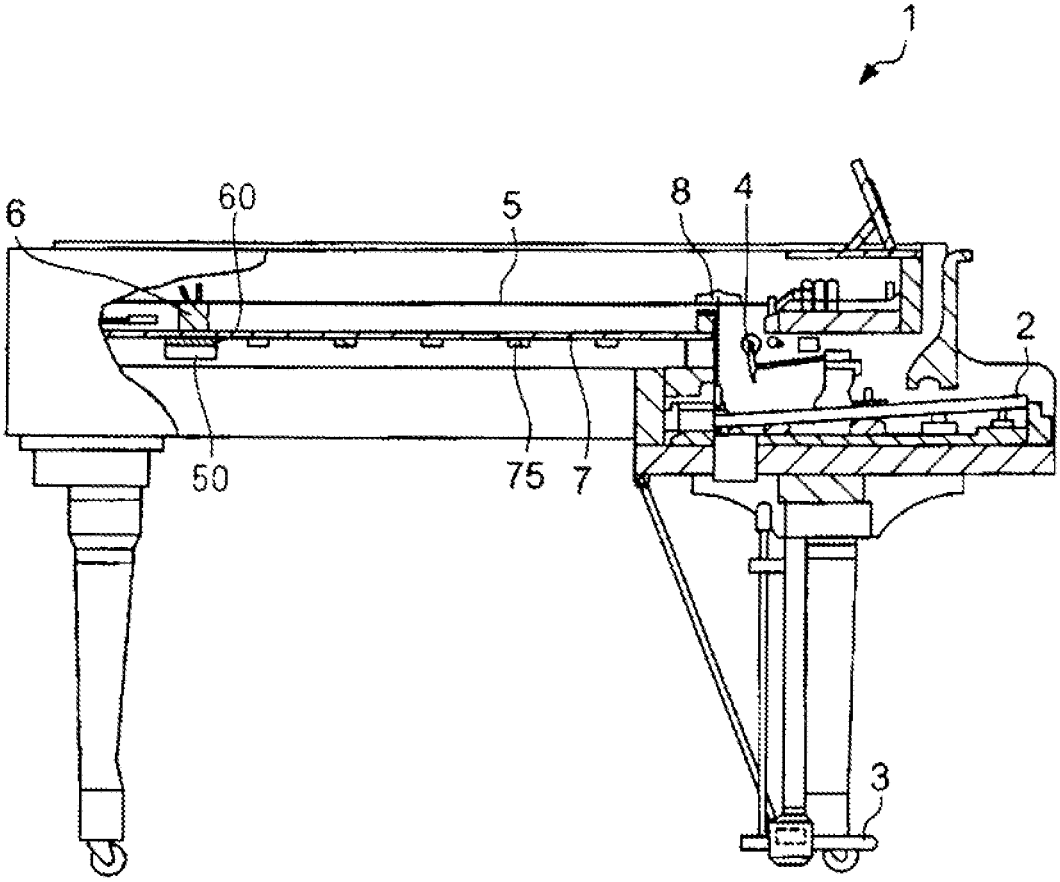
FIG. 2 is a view illustrating the internal structure of the grand piano according to the first embodiment.

FIG. 2 is a view illustrating the internal structure of the grand piano 1. In this figure, with respect to the configurations provided for the respective keys 2, attention is paid to only one key 2 and the description thereof is given, and with respect to the portions provided for the other keys 2, the description thereof is omitted.

Each of hammers 4 is provided for respective one of the keys 2. When the key 2 is depressed, the force applied thereto is transmitted to the hammer 4 via an action mechanism (not shown), whereby the hammer 4 is moved and strikes the string (sounding body) 5 corresponding to the key 2. Furthermore, a damper 8 becomes in a non-contact state or a contact state with the string 5 depending on the depressed amount of the key 2 and the stepping amount of a damper pedal, one of the pedals 3, (hereafter, in the case that the term "pedal 3" is simply used, it means the damper pedal). When in contact with the string 5, the damper 8 suppresses the vibration of the string 5.

The soundboard 7 is a plate-like member made of wood. On the front surface of the soundboard 7, two bridges 6 (6H, 6L) being different in length are provided, and on the back surface thereof, a plurality of sound ribs 75 are disposed. In the case of an ordinary piano performance, the vibration of the string 5 struck by the hammer 4 is transmitted to the soundboard 7 via the bridges 6. Of the two bridges 6, the long bridge 6H supports the string 5 on the high-pitched sound side thereof, and the short bridge 6L supports the string 5 on the low-pitched sound side thereof. In the following description, in the case that it is not particularly necessary to distinguish between the long bridge 6H and the short bridge 6L, the bridge is simply referred to as the bridge 6.

An acceleration sensor 50 constituting a pickup device 100 (see FIG. 4) according to this embodiment, described later, is secured to the soundboard 7 using a mounting member 60. The mounting member 60 may merely be a member capable of mounting the acceleration sensor 50 on the soundboard 7. A double-sided tape or an adhesive is taken as an example of the mounting member 60. The acceleration sensor 50 is used to detect the acceleration of the vibration of the soundboard 7. In this embodiment, the acceleration sensor 50 is a three-dimensional acceleration sensor and detects the acceleration of the vibration of the soundboard 7 in the horizontal directions and the vertical direction. However, the acceleration sensor 50 is not limited to such a three-dimensional acceleration sensor but may be a multidimensional (two-dimensional or more) acceleration sensor or may be a one-dimensional acceleration sensor.

Figure 3:
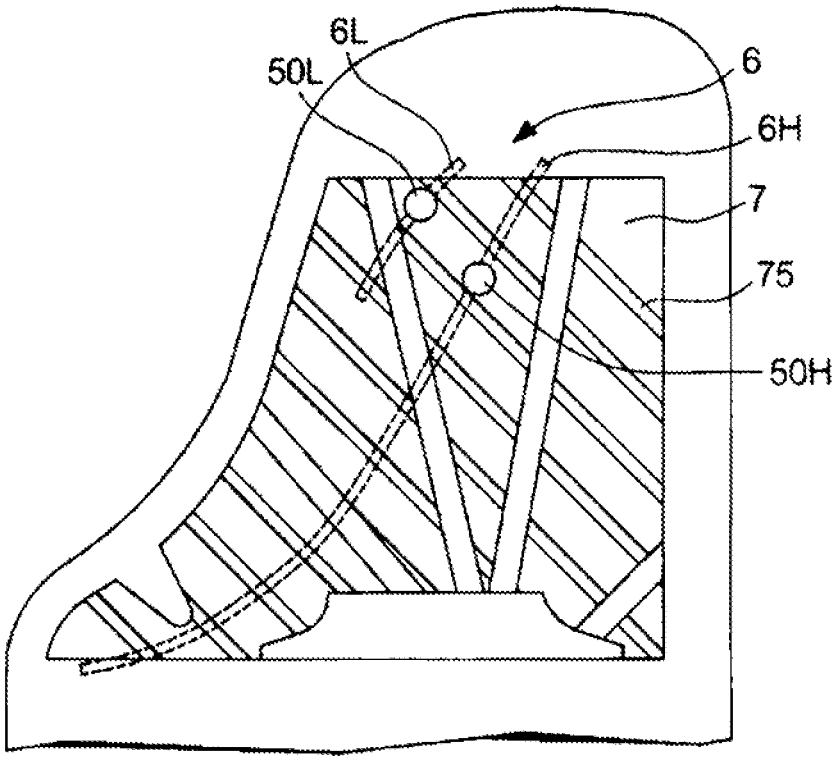
FIG. 3 is a view illustrating the arrangement of acceleration sensors according to the first embodiment.

FIG. 3 is a view illustrating the arrangement of the acceleration sensor 50 and a view obtained when the grand piano 1 is seen from below. In this example, two acceleration sensors 50H and 50L are provided as the acceleration sensor 50. In the following description, in the case that it is not particularly necessary to distinguish between the acceleration sensors 50H and 50L, the acceleration sensor is simply referred to as the acceleration sensor 50.

In the example shown in FIG. 3, each of the acceleration sensors 50H and 50L is provided between the two sound ribs 75 on the back surface (lower surface) of the soundboard 7. Of these acceleration sensors, the acceleration sensor 50H is provided at a position opposed to the long bridge 6H with the soundboard 7 held therebetween. On the other hand, the acceleration sensor 50L is provided at a position opposed to the short bridge 6L with the soundboard 7 held therebetween. In other words, the soundboard 7 is held between the two acceleration sensors 50 and the two bridges 6.

Furthermore, the acceleration sensors 50 may be provided on the front surface (upper surface) of the soundboard 7 and at positions opposed to the sound ribs 75 with the soundboard 7 held therebetween. In this case, the soundboard 7 is held between the acceleration sensors 50 and the sound ribs 75. Moreover, the acceleration sensors 50 may be provided in the vicinity of the sound ribs 75 irrespective of the front and back surfaces of the soundboard 7.

Still further, in the case that one or plurality of acceleration sensors 50 are located at positions where they can detect the acceleration of the vibration of the soundboard 7, the soundboard 7 is not required to be held between the acceleration sensors 50 and the bridges 6 or between the acceleration sensors 50 and the sound ribs 75, but may be provided at an arbitrary position. What's more, the number of the acceleration sensors 50 is not limited to two, but may be larger, or only one acceleration sensor 50 may be provided on the soundboard 7.

Moreover, the position of the acceleration sensor 50 may be set depending on the direction of the grain of the wood from which the soundboard 7 is formed. This is because the vibration of the soundboard 7 depends on the direction of the grain of the wood which is the material of the soundboard 7. For example, the acceleration sensor 50 may be the two-dimensional acceleration sensor or the three-dimensional acceleration sensor, and be provided so that one direction in which the acceleration sensor 50 detects the acceleration is parallel with the direction of the grain, and another direction in which the acceleration sensor 50 detects the acceleration is perpendicular to the direction of the grain. The soundboard 7 has vibration transmission characteristics being different between the direction parallel with the direction of the grain and the direction perpendicular to the direction of the grain. Thus, the difference between the tone generated by the vibration in the direction parallel with the direction of the grain and the tone generated by the vibration in the direction perpendicular to the direction of the grain is the largest. Therefore, the acceleration of the vibration of the soundboard 7, which is closer to the sound of the piano, can be detected by providing the acceleration sensor 50 as described above.

Figure 4:
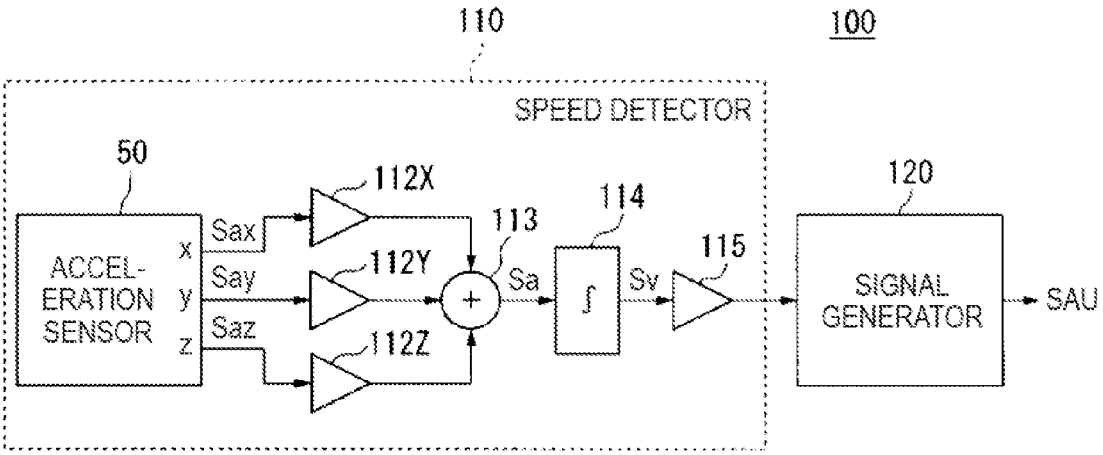
FIG. 4 is a view showing an example of the configuration of a pickup device according to the first embodiment.

FIG. 4 is a view showing an example of the configuration of the pickup device 100 according to the first embodiment.

The pickup device 100 is equipped with a speed detector 110 and a signal generator 120. The speed detector 110 is used to detect the vibration speed of the soundboard 7 of the grand piano 1. The speed detector 110 is equipped with the acceleration sensor 50 (50H, 50L), pre-amplifiers 112X, 112Y and 112Z, an adder 113, an integrator 114 and a gain adjustment amplifier 115.

The acceleration sensor 50 detects the vibration acceleration of the soundboard 7 of the grand piano 1 and outputs acceleration signals Sax, Say and Saz indicating the x, y and Z components of the acceleration, respectively. In this embodiment, the x and y components of the vibration acceleration of the soundboard 7 are the components of the vibration acceleration of the soundboard 7 in the horizontal directions (two-dimensional directions), and the z component thereof is the component of the vibration acceleration of the soundboard 7 in the vertical direction. These x, y and Z components are components are not on the same plane. However, the definitions of the x, y and z components of the acceleration are not limited to this example but can be set arbitrarily.

The pre-amplifiers 112X, 112Y and 112Z are used to amplify the acceleration signals Sax, Say and Saz output from the acceleration sensor 50, respectively. The respective amplitudes of the pre-amplifiers 112X, 112Y and 112Z can be set arbitrarily so that desired sound is reproduced from the audio signal SAU output from the pickup device 100 depending on, for example, the mounting position of the acceleration sensor 50. Since the characteristics of the acceleration signals Sax, Say and Saz are reflected on the output signals of the pre-amplifiers 112X, 112Y and 112Z, respectively, in this embodiment, the output signals of the pre-amplifiers 112X, 112Y and 112Z are used as the acceleration signals Sax, Say and Saz.

The adder 113 is used to add the acceleration signals Sax, Say and Saz amplified by the pre-amplifiers 112X, 112Y and 112Z, respectively, and outputs an addition signal Sa indicating the result of the addition.

The integrator 114 integrates the result of the addition of the acceleration signals Sax, Say and Saz input from the adder 113 as the addition signal Sa and outputs a signal Sv indicating the result of the integration. Since the signal Sv indicating the result of the integration of the addition signal Sa of the acceleration signals Sax, Say and Saz indicating the vibration acceleration of the soundboard 7 indicates the vibration speed of the soundboard 7, the signal Sv is hereafter referred to as the speed signal Sv.

The gain adjustment amplifier 115 is used to adjust the gain of the speed detector 110 for the vibration of the soundboard 7.

The signal generator 120 is used to generate the audio signal SAU from the speed signal Sv indicating the speed detected by the speed detector 110 and to output the signal. In this embodiment, the signal generator 120 outputs the speed signal Sv as the audio signal SAU.

In the case that, for example, it is not necessary to adjust the output signal of the acceleration sensor 50, the pre-amplifiers 112X, 112Y and 112Z may be omitted. Furthermore, the pre-amplifiers 112X, 112Y and 112Z may be integrated with the acceleration sensor 50 or the adder 113. In the case that it is not necessary to adjust the gain of the speed detector 110, the gain adjustment amplifier 115 may be omitted. Moreover, the gain adjustment amplifier 115 may be integrated with the integrator 114. In other words, the pre-amplifiers 112X, 112Y and 112Z and the gain adjustment amplifier 115 may merely be provided as necessary and can be omitted.

Next, the operation of the pickup device 100 according to the first embodiment will be described below.

When the player depresses the key 2 of the grand piano 1 during performance, the hammer 4 strikes the string 5, thereby vibrating the string 5. The vibration of the string 5 is transmitted to the soundboard 7 via the bridges 6. As a result, the soundboard 7 vibrates and generates sound.

The acceleration sensor 50 detects the vibration of the soundboard 7 and outputs the acceleration signals Sax, Say and Saz indicating the three-dimensional components of the acceleration of the vibration. The acceleration signals Sax, Say and Saz are amplified by the pre-amplifiers 112X, 112Y and 112Z, respectively, and supplied to the adder 113. The adder 113 adds the acceleration signals Sax, Say and Saz amplified by the pre-amplifiers 112X, 112Y and 112Z and outputs the addition signal Sa. The integrator 114 time-integrates the addition signal Sa and outputs the speed signal Sv indicating the vibration speed of the soundboard 7. The speed signal Sv is amplified by the gain adjustment amplifier 115 and then output from the speed detector 110 to the signal generator 120.

On the basis of the speed signal Sv input from the speed detector 110, the signal generator 120 generates the audio signal SAU for reproducing sound having sound pressure p represented by the following expression (1) and outputs the signal.

$$\begin{aligned} p &= Z_a u \\ &= Z_a Sv \\ &= Z_a S \int a dt \end{aligned} \tag{1}$$

where Za is an acoustic impedance and a static value having the position of the soundboard 7 and the position of a listener as parameters. u is the volume speed of the vibration of the soundboard 7. S is the area of the vibration plane of the soundboard 7. v is the vibration speed of the soundboard 7. a is the vibration acceleration of the soundboard 7.

As understood from the expression (1), the sound pressure p is proportional to the speed v. Furthermore, the speed v is obtained by integrating the vibration acceleration a of the soundboard 7. In the speed detector 110 according to this embodiment, the speed signal Sv indicating the vibration speed v of the soundboard 7 is obtained by integrating the addition signal Sa serving as the result of the addition of the acceleration signals Sax, Say and Saz indicating the vibration acceleration a of the soundboard 7 using the integrator 114. And in the signal generator 120, the audio signal SAU for reproducing the sound having the sound pressure p proportional to the vibration speed v of the soundboard 7 is generated from the speed signal Sv.

The audio signal SAU output from the signal generator 120 is power-amplified by, for example, a power amplifier (not shown) and supplied to a sound emitting device (not shown), such as a speaker. The sound emitting device is driven by the power-amplified audio signal SAU and converts the audio signal SAU into sound. As a result, the sound generated from the soundboard 7 of the grand piano 1 is picked up by the pickup device 100 and emitted from the sound emitting device.

With this embodiment, since the sound pressure p proportional to the vibration speed v of the soundboard 7 is reproduced by the audio signal SAU, natural piano sound can be reproduced.

Furthermore, with this embodiment, since the acceleration sensor 50 hardly detects the vibration due to the sound emitted from the sound emitting device, howling hardly occurs.

Moreover, with this embodiment, since the soundboard 7, on which the acceleration sensor 50 is mounted, has numerous exposed portions, the mounting work for the sensor is easy.

What's more, with this embodiment, since a three-dimensional acceleration sensor is used as the acceleration sensor 50, the vibration acceleration of the soundboard 7 can be detected in the three-dimensional directions, whereby the vibration components of the soundboard 7, not obtained by using, for example, a piezoelectric element or a microphone, can be detected. More specifically, the three-dimensional acceleration sensor can detect not only the vertical acceleration component of the vibration of the soundboard 7 but also the horizontal acceleration components including numerous harmonic components. Since the audio signal SAU is generated on the basis of the speed obtained by integrating the acceleration components, the sound pressure can be reproduced sufficiently, and the sound of the piano can be reproduced with reality.

Still further, since the acceleration sensor is more inexpensive than other sensors, such as a piezoelectric sensor, the pickup device 100 can be realized inexpensively.

<Second Embodiment>

Next, a second embodiment according to the present invention will be described below.

Figure 5:
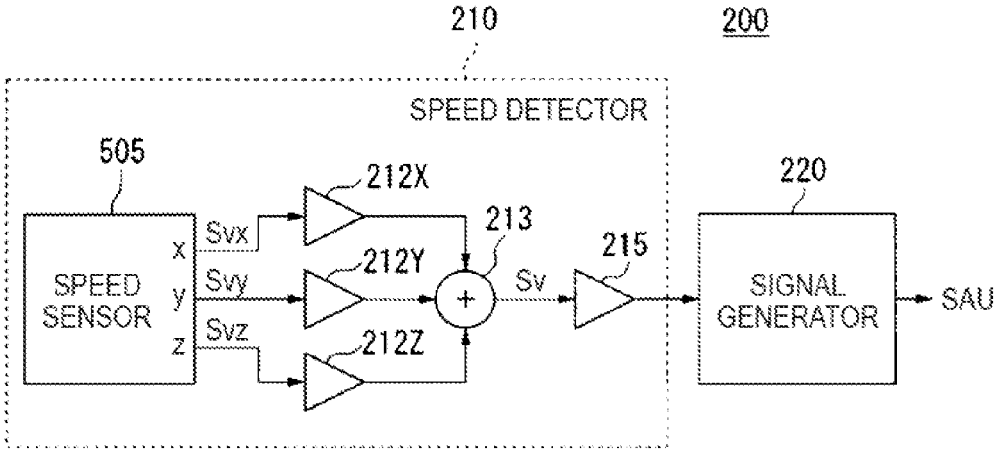
FIG. 5 is a view showing an example of the configuration of a pickup device according to a second embodiment.

FIG. 5 is a view showing an example of the configuration of a pickup device 200 according to the second embodiment.

Figure 6:
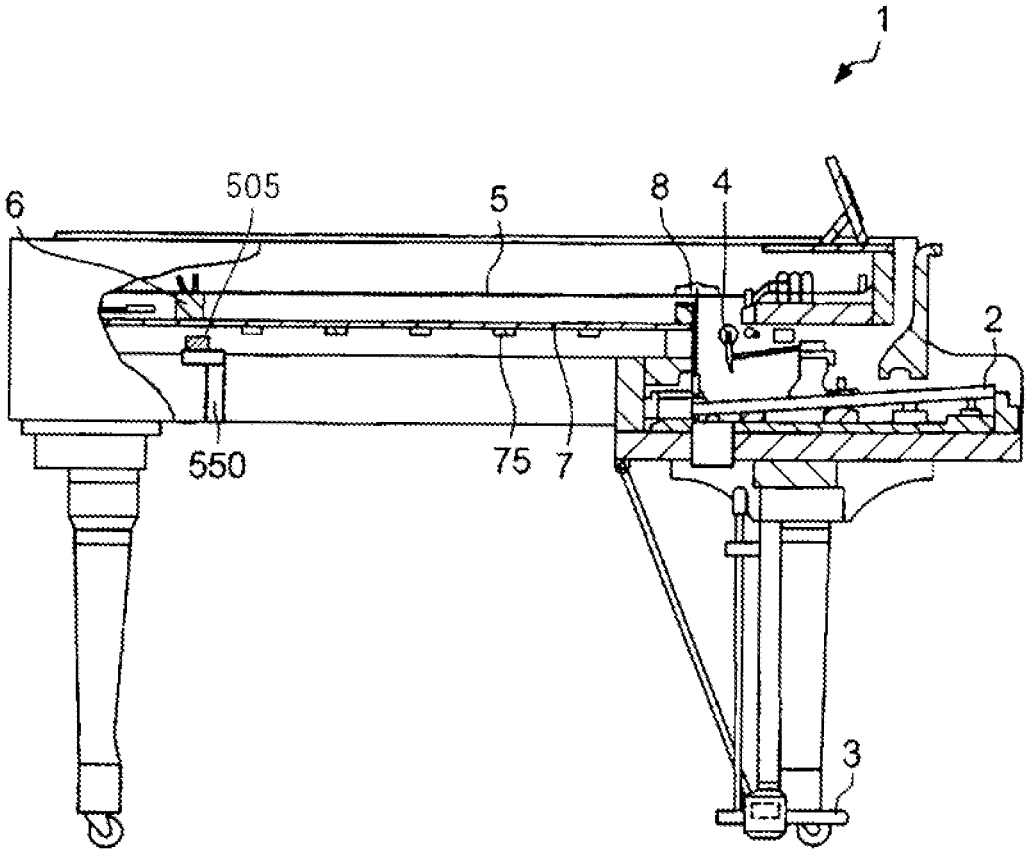
FIG. 6 is a view illustrating the arrangement of a speed sensor according to the second embodiment.

FIG. 6 is a view illustrating the arrangement of a speed sensor 505 according to the second embodiment.

Generally speaking, the configuration of the pickup device 200 is made different from the configuration of the pickup device 100 according to the first embodiment shown in FIG. 4 described above in that the acceleration sensor 50 is replaced with the speed sensor 505 and that the integrator 114 is eliminated.

More specifically, the pickup device 200 is equipped with a speed detector 210 and a signal generator 220. The speed detector 210 is used to detect the speed of the vibration of the soundboard 7 of the grand piano 1 and is equipped with the speed sensor 505, pre-amplifiers 212X, 212Y and 212Z, an adder 213, and a gain adjustment amplifier 215.

The speed sensor 505 is a three-dimensional speed sensor, detects the vibration speed of the soundboard 7 of the grand piano 1 and outputs speed signals Svx, Svy and Svz indicating the x, y and Z components of the speed, respectively. The speed sensor 505 is mounted on the soundboard 7, for example as shown in FIG. 6, by providing a speed sensor holder 550 on a brace of the piano and by securing the speed sensor 505 with a securing member to the position on the speed sensor holder 550 opposed to the soundboard 7. A screw, an adhesive or the like is taken as an example of the securing member. In this embodiment, the x and y components of the vibration speed of the soundboard 7 are the components of the vibration speed of the soundboard 7 in the horizontal directions (two-dimensional directions) of the soundboard 7, and the z component thereof is the component of the vibration speed of the soundboard 7 in the vertical direction. The definitions of the x, y and z components are similar to those in the first embodiment.

The speed sensor 505 is not limited to such a three-dimensional speed sensor but may be a multidimensional (two-dimensional or more) speed sensor or may be a one-dimensional speed sensor.

The pre-amplifiers 212X, 212Y and 2122 are used to amplify the speed signals Svx, Svy and Svz output from the speed sensor 505, respectively. The pre-amplifiers 212X, 212Y and 212Z are similar to the pre-amplifiers 112X, 112Y and 112Z provided for the pickup device 100 according to the first embodiment shown in FIG. 4 described above. In this embodiment, the output signals of the pre-amplifiers 212X, 212Y and 212Z are referred to as the speed signals Svx, Svy and Svz, respectively.

The adder 213 is used to add the speed signals Svx, Svy and Svz amplified by the pre-amplifiers 212X, 212Y and 212Z and outputs a speed signal Sv indicating the result of the addition. The adder 213 is similar to the adder 113 provided for the pickup device 100 according to the first embodiment shown in FIG. 4 described above.

The gain adjustment amplifier 215 is used to adjust the gain of the speed detector 210 for the vibration of the soundboard 7. The gain adjustment amplifier 215 is similar to the gain adjustment amplifier 115 provided for the pickup device 100 according to the first embodiment shown in FIG. 4 described above.

The signal generator 220 is used to generate the audio signal SAU from the speed signal Sv indicating the speed detected by the speed detector 210 and to output the signal, and is similar to the signal generator 120 provided for the pickup device 100 according to the first embodiment shown in FIG. 4 described above.

As in the case of the first embodiment, in the second embodiment, the pre-amplifiers 212X, 212Y and 212Z may be omitted as necessary, or the pre-amplifiers 212X, 212Y and 212Z may be integrated with the speed sensor 505 or the adder 213. Furthermore, the gain adjustment amplifier 215 may be omitted or the gain adjustment amplifier 215 may be integrated with the adder 213.

Next, the operation of the pickup device 200 according to the second embodiment will be described below.

In the second embodiment, the speed sensor 505 detects the vibration of the soundboard 7 and outputs the speed signals Svx, Svy and Svz indicating the three-dimensional components of the speed of the vibration. The speed signals Svx, Svy and Svz are amplified by the pre-amplifiers 212X, 212Y and 212Z, respectively, and supplied to the adder 213. The adder 213 adds the speed signals Svx, Svy and Svz amplified by the pre-amplifiers 212X, 212Y and 212Z and outputs the speed signal Sv. The speed signal Sv is amplified by the gain adjustment amplifier 215 and then output from the speed detector 210 to the signal generator 220.

On the basis of the speed signal Sv input from the speed detector 210, the signal generator 220 generates the audio signal SAU for reproducing sound having sound pressure p represented by the following expression (2) and outputs the signal.

$$p = Z_a u = Z_a S v \quad (2)$$

where Za is an acoustic impedance and a static value having the position of the soundboard 7 and the position of a listener as parameters. u is the volume speed of the vibration of the soundboard 7. S is the area of the vibration plane of the soundboard 7. v is the vibration speed of the soundboard 7.

As understood from the expression (2), the sound pressure p is proportional to the speed v. In the speed detector 210 according to this embodiment, the audio signal SAU for reproducing the sound having the sound pressure p proportional to the speed v is generated from the speed signal Sv serving as the result of the addition of the speed signals Svx, Svy and Svz indicating the vibration speed v of the soundboard 7. As in the case of the first embodiment, the audio signal SAU is power-amplified by, for example, a power amplifier (not shown) and supplied to a sound emitting device (not shown), such as a speaker.

In comparison with the first embodiment, the second embodiment is not required to be provided with the integrator 114, whereby the configuration of the device can be made simple.

Furthermore, also in the second embodiment, an effect similar to that of the first embodiment can be obtained. In other words, with the second embodiment, since the sound having the sound pressure p proportional to the vibration speed v of the soundboard 7 is reproduced by the audio signal SAU, natural piano sound can be reproduced. Moreover, since the speed sensor 505 hardly detects the vibration due to the sound emitted from the sound emitting device, howling hardly occurs. What's more, the mounting work for mounting the pickup device 200 on the grand piano 1 is easy. Still further, since a three-dimensional speed sensor is used as the speed sensor 505, the sound of the piano can be reproduced with reality.

Although the embodiments according to the present invention have been described above, the present invention is not limited to the above-mentioned embodiments, but various modifications, replacements, additions, etc. can be made.

For example, although the integrator 114 is provided in the post-stage of the adder 113 in the first embodiment, an integrator may be provided in the post-stage of each of the pre-amplifiers 112X, 112Y and 112Z.

Furthermore, although the acceleration signals Sax, Say and Saz amplified by the pre-amplifiers 112X, 112Y and 112Z are added by the adder 113 in the first embodiment, for example, a configuration may also be used in which the acceleration signal Saz is added to the result of the addition of the acceleration signals Sax and Say. The same applies to the second embodiment.

According to an aspect of the present invention, the occurrence of howling can be suppressed and the natural sound of an acoustic musical instrument can be reproduced.

What is claimed is:

1. A pickup device comprising:

a speed detector configured to detect a speed of vibration of a soundboard of an acoustic musical instrument; and a signal generator configured to generate an audio signal from the speed detected by the speed detector and to output the audio signal, wherein the speed detector includes:

an acceleration sensor configured to detect an acceleration of the vibration of the soundboard of the acoustic musical instrument and output a first component of the acceleration, a second component of the acceleration, and a third component of the acceleration;

an adder configured to add the first component of the acceleration, the second component of the acceleration, and the third component of the acceleration and to output an addition signal indicating the result of the addition; and an integrator configured to integrate the addition signal.

2. The pickup device according to claim 1, wherein the acceleration sensor is provided on the soundboard.

3. The pickup device according to claim 1, wherein the acceleration sensor is provided so that one direction in which the sensor detects the acceleration is parallel with a direction of a grain from which the soundboard is formed.

4. The pickup device according to claim 1, wherein the acoustic musical instrument is a piano, and the speed detector is provided at a position opposed to a bridge with the soundboard held therebetween.

5. The pickup device according to claim 1, wherein the acoustic musical instrument is a piano, and the speed detector is provided at a position opposed to a sound rib with the soundboard held therebetween.

6. The pickup device according to claim 1, wherein the acoustic musical instrument is a piano, and the speed detector is provided in the vicinity of a sound rib.

7. A pickup device comprising:

a detector configured to detect a speed of vibration of a soundboard of an acoustic musical instrument; and a signal generator configured to generate an audio signal according to the speed detected by the detector and to output the audio signal, the audio signal having a sound pressure proportional to the speed of the soundboard.

8. The pickup device according to claim 7, wherein the detector includes:

an acceleration sensor configured to detect an acceleration of the vibration of the soundboard; and an integrator configured to integrate an output signal of the acceleration sensor to thereby generate a signal indicating the speed of vibration of the soundboard.

9. A pickup device comprising:

a detector configured to detect a speed of vibration of a soundboard of an acoustic musical instrument; and a signal generator configured to generate an audio signal according to the speed detected by the detector and to output the audio signal, the audio signal having a sound pressure proportional to the speed of the soundboard, wherein the detector includes:

a speed sensor configured to detect a speed of the vibration of the soundboard; and an adder configured to add at least two signals output from the speed sensor to thereby generate a signal indicating the speed of vibration of the soundboard.

10. A pickup device comprising:

a speed detector configured to detect a speed of vibration of a soundboard of an acoustic musical instrument; and a signal generator configured to generate an audio signal from the speed detected by the speed detector and to output the audio signal, wherein the speed detector is provided at a position opposed to a bridge with the soundboard held therebetween.

11. A pickup device comprising:

a speed detector configured to detect a speed of vibration of a soundboard of an acoustic musical instrument; and a signal generator configured to generate an audio signal from the speed detected by the speed detector and to output the audio signal, wherein the speed detector is provided at a position opposed to a sound rib with the soundboard held therebetween.

12. A pickup device comprising:

a speed detector configured to detect a speed of vibration of a soundboard of an acoustic musical instrument; and a signal generator configured to generate an audio signal from the speed detected by the speed detector and to output the audio signal, wherein the speed detector is provided in the vicinity of a sound rib.

* * * * *